US006156157A

United States Patent [19]

Schroeder et al.

[11] Patent Number: 6,156,157

[45] Date of Patent: Dec. 5, 2000

[54] METHOD FOR MAKING SOFT TISSUE WITH IMPROVED BULK SOFTNESS AND SURFACE SOFTNESS

[75] Inventors: Wen Zyo Schroeder, Appleton; Gary Vance Anderson, Larson; Duane Gerard Krzysik; Gary Lee Shanklin, both of Appleton; Michael John Smith, Neenah, all of Wis.

[73] Assignee: Kimberly-Clark Worldwide, Inc., Neenah, Wis.

[21] Appl. No.: 08/847,392

[22] Filed: Apr. 21, 1997

Related U.S. Application Data

[63] Continuation of application No. 08/505,838, Jul. 21, 1995, abandoned.

[51] Int. Cl.[7] ..... D21H 21/22

[52] U.S. Cl. ..... 162/135; 162/111; 162/112; 162/158; 162/179; 162/184; 162/185

[58] Field of Search ..... 162/109, 112, 162/135, 158, 179, 184, 185, 111, 164.4

[56] References Cited

U.S. PATENT DOCUMENTS

| | | | |
|---|---|---|---|
| 22,362 | 12/1858 | Glynn | 167/84 |
| 302,073 | 7/1884 | Wheeler | 167/84 |
| 967,688 | 8/1910 | Titherley | 167/84 |
| 2,251,328 | 8/1941 | Ehret | 252/134 |
| 2,926,116 | 2/1960 | Keim | 162/164 |
| 3,058,873 | 10/1962 | Keim | 162/164 |
| 3,138,533 | 6/1964 | Heim et al. | 167/84 |
| 3,227,614 | 1/1966 | Scheuer | 167/84 |
| 3,264,188 | 8/1966 | Gresham | 167/84 |
| 3,489,148 | 1/1970 | Duncan et al. | 128/284 |
| 3,499,823 | 3/1970 | Croon et al. | 162/158 |
| 3,585,998 | 6/1971 | Hayford et al. | 128/284 |
| 3,755,220 | 8/1973 | Freimark et al. | 260/17.3 |
| 3,814,096 | 6/1974 | Weiss et al. | 128/268 |
| 3,896,807 | 7/1975 | Buchalter | 128/261 |
| 4,112,167 | 9/1978 | Dake et al. | 428/154 |
| 4,117,187 | 9/1978 | Adams et al. | 428/286 |
| 4,158,594 | 6/1979 | Becker et al. | 162/112 |
| 4,209,449 | 6/1980 | Mayhew et al. | 544/157 |
| 4,300,981 | 11/1981 | Carstens | 162/109 |
| 4,432,834 | 2/1984 | Whitfield et al. | 162/158 |
| 4,441,962 | 4/1984 | Osborn, III | 162/158 |
| 4,447,294 | 5/1984 | Osborn, III | 162/158 |
| 4,448,638 | 5/1984 | Klowak | 162/158 |
| 4,482,429 | 11/1984 | Klowak | 162/158 |
| 4,528,316 | 7/1985 | Soerens | 524/503 |
| 4,550,035 | 10/1985 | Smith | 427/308.1 |
| 4,559,157 | 12/1985 | Smith et al. | 252/90 |
| 4,560,599 | 12/1985 | Regen | 428/36 |
| 4,613,447 | 9/1986 | Hara et al. | 252/91 |
| 4,615,937 | 10/1986 | Bouchette | 428/288 |
| 4,623,339 | 11/1986 | Ciraldo | 128/287 |
| 4,735,860 | 4/1988 | Mizobuchi et al. | 428/423.1 |
| 4,766,015 | 8/1988 | Nikoloff et al. | 427/326 |
| 4,795,530 | 1/1989 | Soerens et al. | 162/111 |
| 4,817,790 | 4/1989 | Porut et al. | 206/205 |
| 4,883,475 | 11/1989 | Bogart et al. | 604/290 |
| 4,904,524 | 2/1990 | Yoh | 428/311.3 |
| 4,943,350 | 7/1990 | Bogart et al. | 162/158 |
| 5,093,452 | 3/1992 | O'Lenick et al. | 528/25 |
| 5,152,928 | 10/1992 | Kudo et al. | 252/351 |
| 5,160,450 | 11/1992 | Okahara et al. | 252/174.21 |
| 5,164,522 | 11/1992 | McCarthy et al. | 554/39 |
| 5,217,576 | 6/1993 | Van Phan | 162/158 |
| 5,237,035 | 8/1993 | O'Lenick, Jr. et al. | 528/27 |
| 5,240,562 | 8/1993 | Van Phan et al. | 162/158 |
| 5,334,286 | 8/1994 | Van Phan et al. | 162/158 |
| 5,352,817 | 10/1994 | McCarthy et al. | 556/423 |
| 5,399,241 | 3/1995 | Oriaran et al. | 162/112 |
| 5,573,637 | 11/1996 | Ampulski et al. | 162/112 |

FOREIGN PATENT DOCUMENTS

| | | |
|---|---|---|
| 866298 | 8/1978 | Brunei Darussalam . |
| 1195562 | 10/1985 | Canada . |
| 116512 | 8/1984 | European Pat. Off. . |
| 132128 | 1/1985 | European Pat. Off. . |
| 0 347 153A2 | 12/1989 | European Pat. Off. . |
| 2 481 333 | 10/1981 | France . |
| 1118781 | 12/1961 | Germany . |
| 024811 | 2/1987 | Germany . |
| 63023976 | 1/1988 | Japan . |
| 1-93506 | 4/1989 | Japan . |
| 406016684 | 1/1994 | Japan . |
| 406136128 | 5/1994 | Japan . |
| 1407134 | 9/1975 | United Kingdom . |
| 2033751 | 5/1980 | United Kingdom . |
| 94/05720 | 9/1993 | WIPO . |
| WO 94/05857 | 3/1994 | WIPO . |

OTHER PUBLICATIONS

Imperante, J., O'Lenick, Jr., A. and Hannon, J. *Silicone Phosphobetaines*, Cosmetics & Toiletries, vol. 190, Mar. 1994, pp. 81–86.

Beran, R. L., *The Evaluation and Selection of Forming Fabrics*, TAPPI, vol. 62, No. 4, Apr. 1979, pp. 39–44.

Patent Cooperation Treaty Search Report from the International Search Authority, International Application No. PCT/US 96/11780 dated Dec. 4, 1996.

*Primary Examiner*—Peter Chin

*Attorney, Agent, or Firm*—Gregory E. Croft

[57] ABSTRACT

The invention relates to tissue products having improved softness properties and methods of making them. Specifically, improved softness is achieved by incorporating one or more softeners/debonders into the fiber furnish at the wet end of the tissue machine prior to formation, followed by a topical treatment with one or more softeners/debonders after the tissue web is dried. The result is a tissue product with added bulk and a smooth surface feel, both properties contributing to improved softness characteristics.

5 Claims, No Drawings

METHOD FOR MAKING SOFT TISSUE WITH IMPROVED BULK SOFTNESS AND SURFACE SOFTNESS

This application is a continuation of application Ser. No. 08/505,838 entitled "Method For Making Soft Tissue With Improved Bulk Softness And Surface Softness" and filed in the U.S. Patent and Trademark Office on Jul. 21, 1995 abandoned. The entirety of this Application is hereby incorporated by reference.

BACKGROUND OF THE INVENTION

Improving the softness of tissues is a continuing objective in tissue manufacture. In general, prior efforts have been directed at reducing the inter-fiber bonding within the tissue structure or coating the tissue surface with chemicals which improve the surface feel. Softness, however, is a perceived property of tissues comprising many factors including bulk softness and surface smoothness. To date, efforts have tended to focus on one or the other. Hence, there is a need for a method which improves both bulk softness and surface softness.

SUMMARY OF THE INVENTION

It has now been discovered that softness of tissues can be improved by the combined addition of one or more softener/debonders (hereinafter defined) to the tissue making furnish, followed by a second addition of one or more softener/debonders to the surface of the dried tissue. The initial introduction of the softener/debonder to the furnish provides more of a bulk softness to the tissue, while the subsequent topical application imparts a more smooth or slick surface feel. The combination results in a very soft-feeling tissue product.

More specifically, the invention resides in a method for making soft tissue comprising: (a) forming an aqueous suspension of papermaking fibers having from about 0.01 to about 6 weight percent based on dry fiber of one or more softener/debonders; (b) forming a tissue web by depositing the aqueous suspension of papermaking fibers onto a forming fabric; (c) dewatering and drying the web; and (d) topically applying to the dried web from about 0.01 to about 10 weight percent, based on dry fiber, of one or more softener/debonders. The softener/debonder which is topically applied to the dry web can be the same softener/debonder added to the furnish prior to forming the tissue web, or it can be different.

As used herein, "softener/debonder" is a chemical compound selected from the group consisting of quaternary ammonium compounds, quaternized protein compounds, phospholipids, silicone quaternaries, quaternized, hydrolyzed wheat protein/dimethicone phosphocopolyol copolymer, organoreactive polysiloxanes, and silicone glycols.

Suitable quaternary ammonium compounds have the following structures:

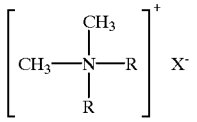

wherein X=chloride, methyl sulfate, or other compatible counterion; and

R=aliphatic, saturated or unsaturated $C_8$–$C_{22}$;

and

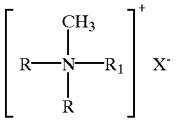

wherein X=chloride, methyl sulfate, or other compatible counterion;

R=aliphatic, saturated or unsaturated $C_8$–$C_{22}$; and $R_1$=benzyl or epoxy group;

and

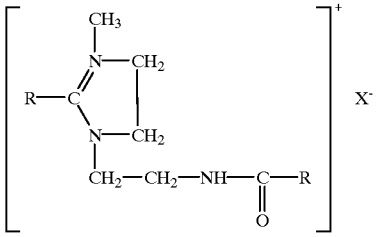

wherein X=chloride, methyl sulfate, or other compatible counterion; and

R=aliphatic, saturated or unsaturated $C_8$–$C_{22}$;

and

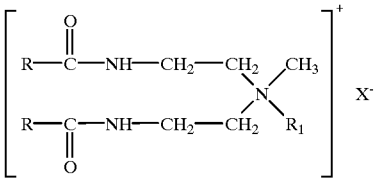

wherein X=methyl sulfate, chloride, or other compatible counterion;

R=aliphatic, normal, saturated or unsaturated, $C_8$–$C_{22}$; and $R_1$=2-hydroxyethyl or 2-hydroxypropyl;

and

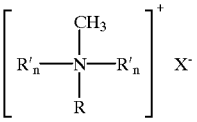

wherein R=aliphatic, normal or branched, saturated or unsaturated, $C_8$–$C_{22}$;

X=chloride, methyl sulfate, ethyl sulfate, or other compatible counterion;

R'=2-hydroxyethyl or polyethoxyethanol; and n=1 to 50;

and

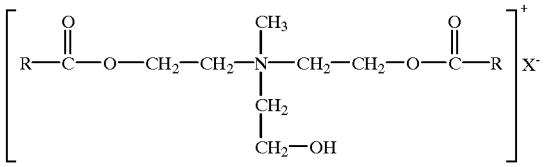

wherein R=$C_8$–$C_{22}$; and

X=methyl sulfate, chloride, or other compatible counterion;

and

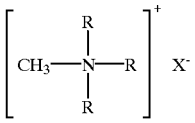

wherein R=aliphatic alkyl, normal or branched, saturated or unsaturated, $C_8$–$C_{22}$; and X=chloride, methyl sulfate or other compatible counterion.

and

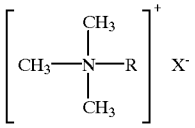

wherein R=aliphatic, saturated or unsaturated, $C_8$–$C_{22}$; or allyl-; or R'—O—$CH_2$—$CH_2$—$CH_2$. where R'=normal or branched, $C_4$–$C_{18}$; and X=chloride, sulfate or any other compatible counterion.

Suitable quaternized protein compounds include the following structures:

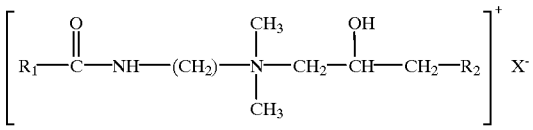

wherein $R_1$=fatty acid radical, saturated or unsaturated, $C_{12}$–$C_{22}$;

$R_2$=hydrolyzed soy protein, hydrolyzed silk protein, collagen, keratin moiety or hydrolyzed wheat protein; and X=chloride, lactate or other compatible counterion;

and

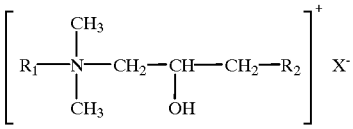

wherein $R_1$=fatty acid radical, saturated or unsaturated, $C_{12}$–$C_{22}$;

$R_2$=hydrolyzed collagen or keratin moiety; and

X=chloride, lactate or other compatible counterion.

Suitable phospholipids include, without limitation, those having the following structures:

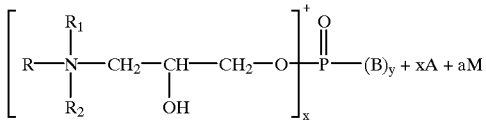

wherein x=1 to 3;

x+y=3;

a=0 to 2;

B=O or OM;

A=an anion;

M=a cation; and

R, $R_1$ & $R_2$ can be the same or different, are alkyl, substituted alkyl, alkyl aryl or alkenyl groups of up to 16 carbon atoms and the total carbon atoms of $R+R_1+R_2$=10 to 24;

and

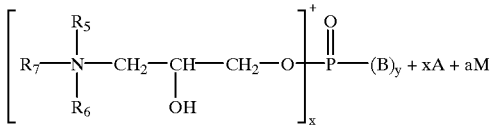

wherein x=1 to 3;

x+y=3;

a=0 to 2;

B=O or OM;

A=an anion;

M=a cation;

$R_5$, $R_6$ may be the same or different, are alkyl, hydroxyalkyl, carboxyalkyl of up to $C_6$, or polyoxyalkylene of up to $C_{10}$; or $R_5$, $R_6$ and the nitrogen they are attached to may represent an N-heterocycle; and $R_7$=an amidoamine moiety of the formula:

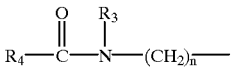

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_4$=alkyl, alkenyl, alkoxy or hydroxyalkyl, $C_5$–$C_{21}$, or aryl or alkaryl of up to $C_{20}$;

and

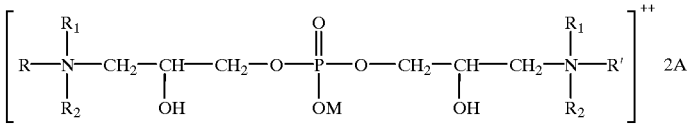

2A wherein A=an anion;

M=a cation;

R, $R_1$ & $R_2$ can be the same or different, are alkyl, substituted alkyl, alkyl aryl or altkenyl groups of up to 16 carbon atoms, and the total carbon atoms of $R+R_1+R_2$=10 to 24; and R' is an amidoamine moiety of the structure:

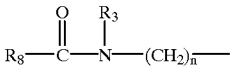

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_8$ has the following structure:

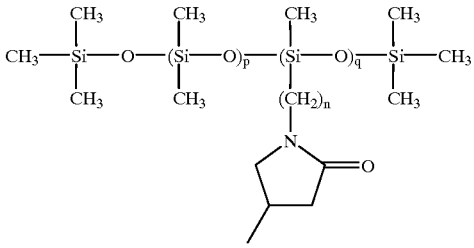

wherein n=3 or greater;

p=1 to 1000;

q=1 to 25.

Suitable silicone quaternaries include the following structure:

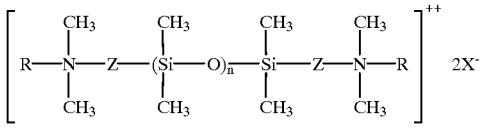

wherein R=alkyl group, $C_{12}$–$C_{18}$;

Z=—$CH_2$—$CH_2$—$CH_2$—O—$(CH_2)_3$—;

X=alkoxy, chloride or other compatible counterion; and n=1 to 50.

Suitable organoreactive polysiloxanes include the following structures:

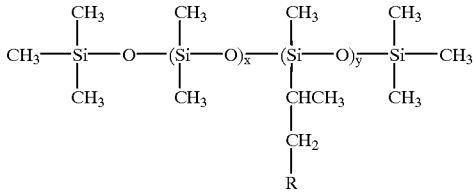

and

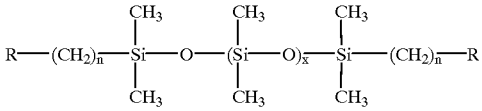

and

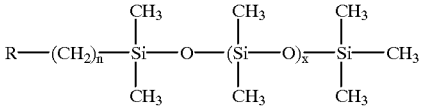

wherein R=amine, carboxy, hydroxy, or epoxy;

n=3 or greater;

x=1 to 1000; and y=1 to 25.

Suitable silicone glycols include the following structure:

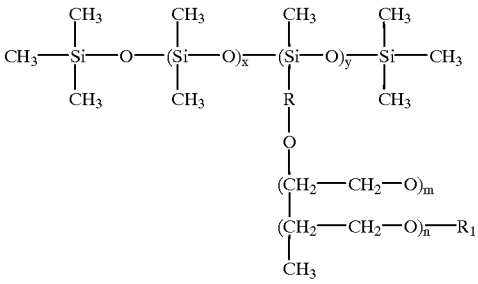

wherein R=alkyl group, $C_1$–$C_6$;

$R_1$=acetate or hydroxy group;

x=1 to 1000;

y=1 to 50;

m=1 to 30; and n=1 to 30.

When a combination of softener/debonder is desired, the combination can be added to the thick stock simultaneously or separately. The combinations can contain one or more compounds from the above groups and added to the slurry, either in a premixed form or individually metered.

The final tissue sheet comprises from about 0.01 to about 6 percent (by weight of the fiber) of the softener/debonders added to the wet end of the tissue making process, individually or in combination. More preferably, the final tissue sheet comprises from about 0.1 to about 3 percent of the softener/debonder added at the wet end, based on the weight of the fiber.

Softener/debonders used for the topical treatment can be delivered in an aqueous solution or be dissolved in a suitable solvent such as propylene glycol, ethylene glycol, polyethylene glycol, isopropyl alcohol, methanol, ethanol or other organic solvents. They can be applied to the surface of the basesheet individually or in combination with others. It is preferred that the composition for topical treatment comprises from about 1 to about 100 weight percent of the softener/debonder (individually or in combination), more preferably from about 35 to about 80 weight percent. It is also preferred that the softener/debonder be topically added to the tissue sheet at an add-on ratio of from about 0.01 to about 10 weight percent of the fiber, and more preferably from about 0.1 to about 2 weight percent of the fiber.

Suitable methods for the topical treatment include, but are not limited to spraying, rotogravure printing, trailing blade coating, flexographic printing, and the like.

EXAMPLES

Example 1

A 2-ply, wet-pressed, creped tissue was made using a layered headbox. The first stock layer (the layer which ultimately contacts the Yankee dryer surface) contained eucalyptus hardwood fiber and provided 60 dry weight percent of the tissue sheet. The remaining 40 percent of the tissue sheet was provided via a second stock layer consisting of northern softwood kraft pulp. The total basis weight of the sheet was 7.3 pounds per 2880 square feet of air dried tissue. Two strength agents were added to the fiber stock layers prior to the headbox. Parez 631NC (a glyoxalated polyacrylamide from Cytec Industries, Inc.) was metered into the softwood thick stock at 0.08 to 0.1 percent of the total fiber weight. Another strength agent, Kymene 557 LX (commercially available from Hercules, Inc.) was metered into both the hardwood and the softwood thick stock at 0.05 and 0.1 percent of the total fiber weight, respectively.

A quaternary ammonium compound softener/debonder (methyl-1-oleyl amidoethyl-2-oleyl imidazolinium methyl sulfate identified as Varisoft 3690 available from Witco Corporation, 90 percent active matter) was added to the hardwood thick stock at 0.17 percent of the total fiber weight.

After drying and creping, the tissue sheet was plied together with a like sheet to form a two-ply tissue. The hardwood layer of both plies was rotogravure-printed with a 40 percent emulsion of an organoreactive polysiloxane (FTS-226 made by OSi Specialties, Inc.) at an add-on amount of 1 percent per ply based on the weight of fiber. The resulting tissue product had increased bulk with improved surface smoothness.

Example 2

A 2-ply layered tissue was made as described in Example 1, except instead of rotogravure-printing both plies with an organoreactive polysiloxane, both plies were instead coated with a silicone phospholipid (Mona Industries, Inc., Item Code #54146, Lot 2426, 25–30% active) having the following structure:

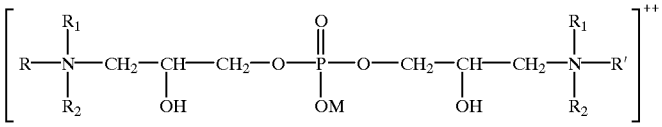

2A wherein A=chloride ion;

M=sodium ion;

$R_1=R_2=—CH_3$

R can be alkyl, substituted alkyl, alkyl aryl or altkenyl groups of up to 16 carbon atoms, and the total carbon atoms of $R+R_1+R_2=10$ to 24; and R' is an amidoamine moiety of the structure:

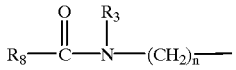

wherein n=3;

$R_3$=hydrogen; and $R_8$ has the following structure:

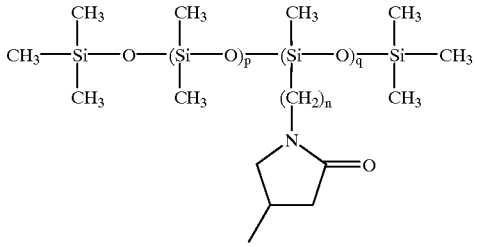

wherein n=3;

p=90;

q=1.

A trailing blade coater was used to apply the silicone phospholipid. The blade angle was set at 30° and blade pressures were varied between 20 and 40 psi to deliver different levels of addition. The resulting tissue products had increased bulk and smooth surface feel.

Example 3

A 2-ply tissue was made as described in Example 2, except both plies were coated with a quaternary ammonium compound (olealkonium chloride, Mackernium KP made by McIntyre Group, LTD., 50% active) having the following structure:

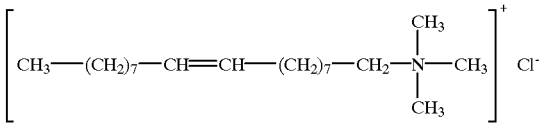

The resulting tissue products had increased bulk and smooth surface feel.

Example 4

A 2-ply layered tissue was made as described in Example 2, except both plies were coated with a silicone quaternary compound (Abilquat 3272 made by Goldschmidt Chemical Corporation, 50% active) having the following structure:

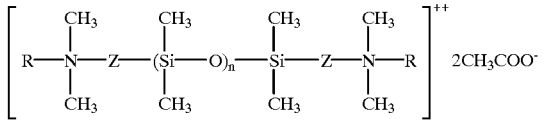

wherein R=alkyl group, $C_{12}$–$C_{18}$;

Z=—$CH_2$—$CH_2$—$CH_2$—O—$(CH_2)_3$—; and n=1 to 50.

The resulting tissue products had increased bulk and smooth surface feel.

Example 5

A 2-ply layered basesheet was made as described in Example 2, except both plies were printed with an aqueous composition comprising 50% of organopolydimethylsiloxane (FTS-226) and 50% quaternary ammonium compound (Mackernium KP). The resulting tissue products had increased bulk and smooth surface feel.

Example 6

A 2-ply layered basesheet was made as described in Example 1, except both plies were coated with an aqueous composition comprising 40% quaternary ammonium compound (Mackernium NLE made by McIntyre Group, LTD.), 40% organopolydimethylsiloxane (FTS-226) and 20% water. Mackernium NLE is an alkylamidopropyl epoxypropyl diammonium chloride, 100 percent active.

The resulting tissue products had increased bulk and smooth surface feel.

Example 7

A two-ply layered basesheet was made as described in Example 2, except both plies were coated with an aqueous composition comprising 25% quaternary ammonium compound (Mackernium KP), 25% organopolysiloxane (FTS-226) and 50% propylene glycol. The resulting tissue products had increased bulk and smooth surface feel.

Example 8

A one-ply, uncreped, through-air-dried tissue was made using a layered headbox. The two outer layers contained bleached eucalyptus hardwood kraft pulp processed through a Maule shaft disperser with a power input of 80 kilowatts at a consistency of about 34 percent and at a temperature of 184° F. The two outer layers made up 70 percent of the tissue sheet by weight of fiber. The middle layer constituted the remaining 30 percent of the tissue web and consisted of bleached northern softwood kraft pulp. The total basis weight of the sheet was 33.9 grams per square meter of air-dried tissue. The inner layer was refined to obtain sufficient dry strength in the final product. A wet strength agent (Parez 631NC) was metered into the inner layer at a rate of 5 kilograms per tonne or 0.5 percent of the weight of fiber. A softener/debonder (quaternary imidazolinium, fatty acid alkoxylate and polyether with 200–800 molecular weight, identified as DPSC 5299-8 from Witco Corporation) was added to the two outer layers at a rate of 5.25 kilograms per tonne (0.525 percent) of the total fiber weight. The thick stock of all layers was diluted to approximately 0.12 percent consistency prior to forming, dewatering and drying the tissue web.

After drying, the tissue was coated with a silicone diquaternary compound (Abilquat 3272) similar to Example 4. The resulting tissue product had a smoother surface feel compared to the tissue without coating.

It will be appreciated that the foregoing examples, given for purposes of illustration, are not to be construed as limiting the scope of this invention, which is defined by the following claims and all equivalents thereto.

We claim:

1. A method for making a soft tissue comprising:

(a) forming an aqueous suspension of papermaking fibers having from about 0.01 to about 6 weight percent, based on dry fiber, of a quaternary ammonium compound having the following structure:

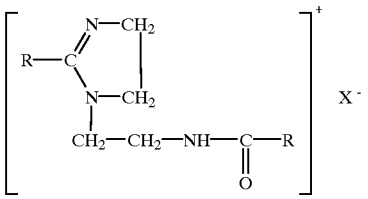

wherein X=chloride, methyl sulfate or other compatible counterion; and

R=aliphatic, saturated or unsaturated, $C_8$–$C_{22}$;

(b) forming a tissue web by depositing the aqueous suspension of papermaking fibers onto a forming fabric;

(c) dewatering and drying the tissue web; and (d) topically applying to the dry tissue web from about 0.01 to about 10 weight percent, based on dry fiber, of a phospholipid having the following structure:

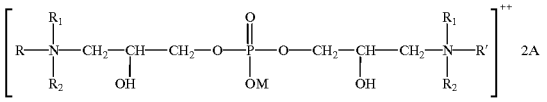

2A wherein A=an anion;

M=a cation;

R, $R_1$ & $R_2$ can be the same or different, are alkyl, substituted alkyl, alkyl aryl or altkenyl groups of up to 16 carbon atoms, and the total carbon atoms of $R+R_1+R_2$=10 to 24; and R' is an amidoamine moiety of the structure:

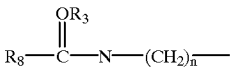

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_8$ has the following structure:

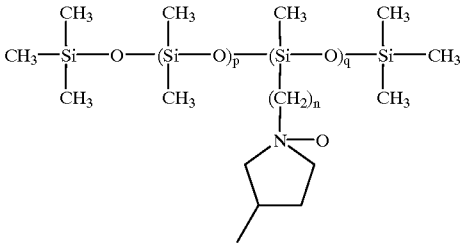

wherein n=3 or greater;
p=1 to 1000; and
q=1 to 25.

2. The method of claim 1 wherein the amount of quaternary ammonium compound added to the fiber suspension is from about 0.1 to about 3 dry weight percent based on the amount of fiber.

3. The method of claim 1 wherein the amount of phospholipid topically applied to the dried web is from about 0.1 to about 10 dry weight percent, based on the amount of fiber.

4. The method of claim 1 wherein the softener/debonder added to the dried web is carried by a solvent selected from the group consisting of water, propylene glycol, ethylene glycol, polyethylene glycol, isopropyl alcohol, methanol and ethanol.

5. The method of claim 1 wherein the amount of phospholipid topically applied to the dried web is from about 0.1 to about 2 dry weight percent based on the amount of fiber.

* * * * *